US005698951A

United States Patent [19]

Maya et al.

[11] Patent Number: 5,698,951

[45] Date of Patent: Dec. 16, 1997

[54] ELECTRODELESS DISCHARGE LAMP AND DEVICE FOR INCREASING THE LAMP'S LUMINOUS DEVELOPMENT

[75] Inventors: Jakob Maya, Brookline; Oleg Popov, Needham; Edward K. Shapiro, Lexington, all of Mass.

[73] Assignee: Matsushita Electric Works Research & Development Labratory, Woburn, Mass.

[21] Appl. No.: 643,777

[22] Filed: May 6, 1996

[51] Int. Cl.[6] ..... H05B 41/16

[52] U.S. Cl. ..... 315/248; 445/41; 445/55; 313/565

[58] Field of Search ..... 315/248, 112; 313/490, 545, 564, 565; 445/41, 55, 38, 40, 53

[56] References Cited

U.S. PATENT DOCUMENTS 4,622,495 11/1986 Smeelen ..... 315/248
5,187,412 2/1993 El-Hamamsy et al. ..... 315/248
5,308,533 5/1994 Hotaling et al. ..... 445/55 X
5,412,288 5/1995 Borowiec et al. ..... 315/248
5,412,289 5/1995 Thomas et al. ..... 315/248
5,500,567 3/1996 Wilson et al. ..... 315/248 X
5,598,069 1/1997 Van Os et al. ..... 315/248
5,621,266 4/1997 Popov et al. ..... 313/46

*Primary Examiner*—Robert Pascal
*Assistant Examiner*—Haissa Philogene

[57] ABSTRACT

An electrodeless fluorescent lamp containing a fill of a rare gas and mercury and a flag (14) disposed therein at a predetermined location in the lamp for increasing the rate of luminous development in the lamp. The flag (14) includes a pair of spaced-apart metallic foil sections (31) and a metallic mesh substrate (30) disposed between the foil sections (31) whereby to be shielded from ion bombardment of the discharge. A coating (30*a*) of indium which is adapted to amalgamate with the mercury is disposed on the mesh (30). The sections are joined together by spot-welding (32) to enable migration of mercury into and out of the space between the sections thereby enable the atoms to form an amalgam with the indium and be rapidly released therefrom.

11 Claims, 3 Drawing Sheets

ELECTRODELESS DISCHARGE LAMP AND DEVICE FOR INCREASING THE LAMP'S LUMINOUS DEVELOPMENT

BACKGROUND OF THE INVENTION

Field of Invention

This invention relates to an electrodeless discharge lamp and a device to increase the rate of luminous development in the lamp while still achieving a long life. Such lamps conventionally comprise a lamp envelope which is sealed in a vacuum-type manner and contains a fill of a mixture of rare gas and mercury. Such lamps have a reentrant cavity into which a coil is inserted and through which a magnetic field is generated to activate the discharge and to obtain mercury ultraviolet resonance radiation (UV light). This UV light, subsequently, impinges upon a phosphor which is coated on the inside walls of the bulb thereby generating visible light.

SUMMARY OF THE PRIOR ART

Lamps of the kind described above, when used in conjunction with a mercury amalgam, have a characteristic of giving relative light output which is independent of ambient temperature in the range of −20° C. to about +70° C. One of the problems with such lamps is to obtain this approximately constant light output independent of ambient temperature. In order to accomplish this an amalgam must be introduced which regulates the vapor pressure of mercury. However, inasmuch as the amalgam solves the problem of obtaining relative light output independent of ambient temperature, an additional problem occurs during start up in that it takes substantial time for the light output to rise to the optimum stable level due to the relatively low mercury vapor pressure of the amalgam. Generally, this problem is more acute at lower ambient temperatures. For example, at −20° C. it takes as much as 10 to 20 minutes, and in some cases 30 minutes, to obtain a stable light output. For many outdoor applications in which light sources remain on for an entire night this may be acceptable, but it is not acceptable for indoor applications where light output is required almost instantaneously.

Therefore, a solution should be provided to rapidly build up the light output at the instant of starting the lamp. Smeelen, U.S. Pat. No. 4,622,495, teaches that by placing a flag containing an amalgam in the vicinity of the magnetic field, mercury can be partially amalgamated in that location. The discharge tends to heat the amalgam rapidly and release the mercury, leading to a relatively rapid increase in luminosity. While this provided a solution, it has also created another problem in that the metallic flag disclosed by Smeelen may result in poor maintenance because any metal introduced into a plasma acquires a potential, whether it is biased with a voltage or left floating. This attracts mercury ions at high energy which leads to sputtering. Due to the ion bombardment of the metal substrate there are some metal particulates which are released and deposited on the wall of the reentrant cavity which causes an irrevocable deterioration of luminosity.

Since one of the basic advantages of an electrodeless lamp is a very long life with good maintenance, the flag can generate a problem and diminish the attractiveness of the light source. Therefore, in order to maintain good light output throughout the life one has to pay extreme attention to light deterioration over the life of the lamp, or maintenance, as is called in the lighting industry.

SUMMARY OF THE INVENTION

According to the present invention we provide an electrodeless fluorescent lamp containing a fill comprising mercury. The lamp includes a bulbous glass envelope having a reentrant cavity adapted to receive a coil. A magnetic field is induced in the volume of the lamp whereby to activate a discharge and to obtain mercury ultraviolet resonance radiation which impinges upon a phosphor which is coated on the inside walls of the envelope, thereby to generate visible light. A flag comprising a pair of spaced-apart metal foil sections containing a foraminous metallic substrate with a coating comprising indium is disposed at a predetermined location in said envelope. Migration of mercury atoms into and out of the space between said sections enables the mercury atoms to form an amalgam with the indium and then be rapidly released from said amalgam, thereby increasing the rate of luminous development in the lamp. Preferably, the sections are formed of iron foil and have a size dimension between about 4 and 8 $mm^2$. The sections are spot-welded together at one or more locations so openings are left about the periphery thereof for the migration of mercury atoms.

An object of the present invention is to rapidly build up luminosity of a lamp during the starting as well as provide a good lamp maintenance over its life.

Another object of this invention is to locate the flag within the lamp envelope to maximize lamp maintenance.

The foregoing objects and other features of the invention will be more particularly described in connection with the preferred embodiment and with reference to the accompanying drawing wherein:

DESCRIPTION OF THE PREFERRED EMBODIMENTS

Figure 1:
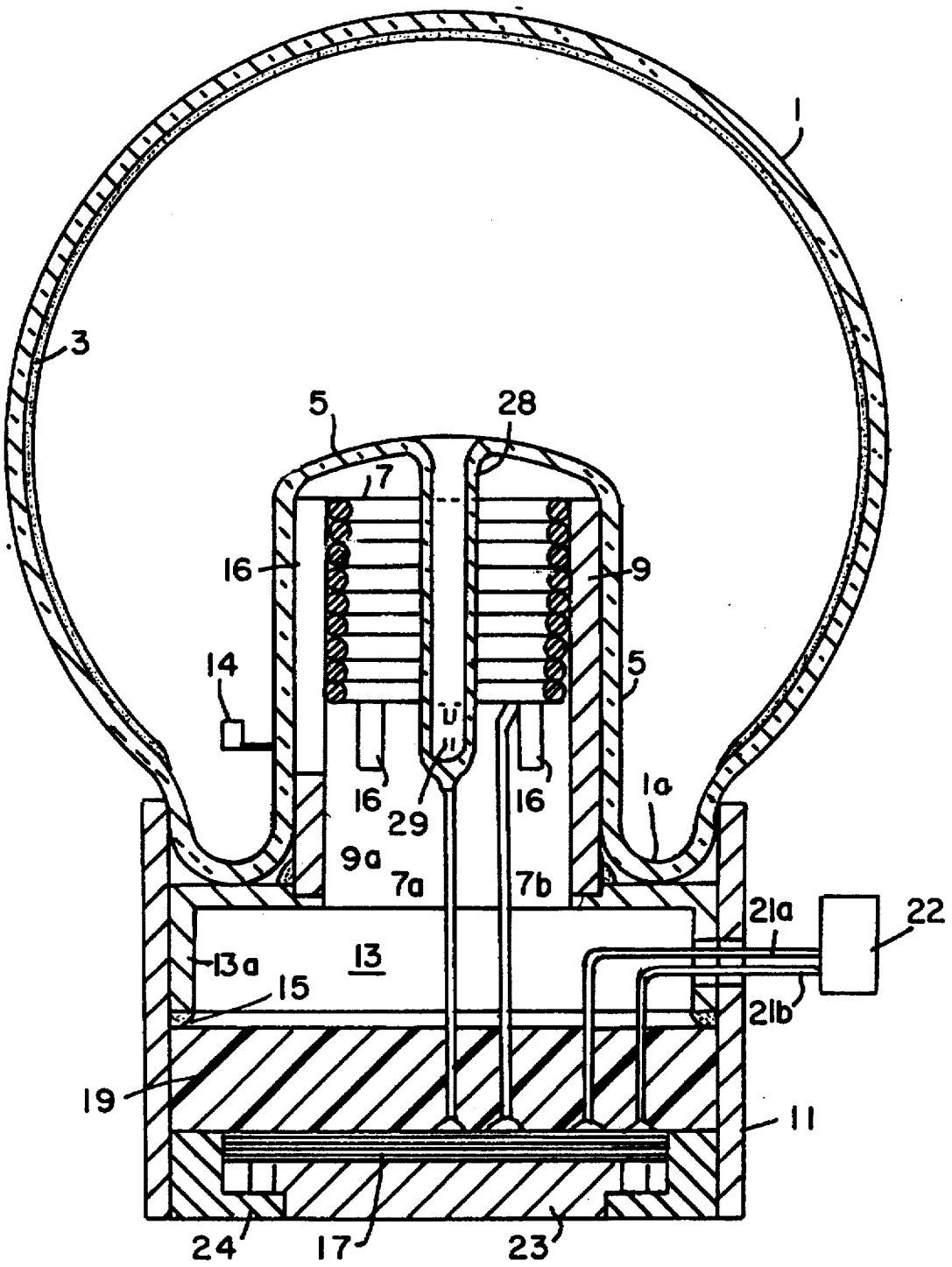
FIG. 1 is a cross-sectional view of an electrodeless florescent lamp including a base, an electromagnetic coil disposed within a reentrant cavity, a conventional matching network and the flag of the present invention.

Referring now to FIG. 1, a bulbous envelope 1 is shown with a coating 3 of a conventional phosphor. A protective coating formed of silica or alumina, or the like, is disposed beneath the phosphor coating 3. The envelope 1 contains a suitable ionizable gaseous fill, for example a mixture of a rare gas (e.g. krypton and/or argon) and a vaporizable metal such as mercury, sodium and/or cadmium. Upon ionization of the gaseous fill, as will be explained hereinafter, the phosphor is stimulated to emit visible radiation upon absorption of ultraviolet radiation. The envelope 1 has a bottom or flare 1*a* disposed within a cylindrical lamp fixture 11. A reentrant cavity 5 extends from the flare 1*a*. The protective coating is also disposed on the inner wall of the cavity 5, as is a reflective coating. A coil 7 is disposed within a cylinder 9. Cylinder 9 is made of a light, conductive material having high thermal conductivity (A1 or Cu, for example). The cylinder 9 is fitted in the reentrant cavity 5 between the coil 7 and the cavity walls. An exhaust tubulation 28 extends from the cavity 5. The cavity 5 extends along the axis of coil 7. The protective coating mentioned above is also disposed within the tubulation 28. A drop of mercury amalgam 29 is disposed within exhaust tubulation 28.

The coil 7 is formed of a thermally conductive metal having a low thermal expansion coefficient, such as copper, coated with a thin layer of silver which provides high electrical conductivity to the coil 7 such that the coil 7 maintains its shape under operating conditions, typically in the range of 50° to 200° C. depending upon the power input to the coil.

The heat removed from the cavity 5 through the metallic cylinder 9 is transferred to the lamp fixture 11 which is attached to the bottom of the lamp base 13 and works as a heat sink. A conventional matching network 17 is disposed in the bottom of the fixture 11 for the operation of the lamp. The coil 7 is connected to the matching network in a conventional manner by wires 7*a* and 7*b* in which wire 7*b* serves as a ground to the matching network 17. Usually, solder or brazing is an appropriate means of forming the electrical connection. Conventional powering wires 21*a* and 21*b* from a power supply 22 are connected to the matching network 17. These wires, 21*a* and 21*b*, pass through openings in the flange 13*a* and fixture 11. An insulator 19, sometimes made of plastic, is disposed between support frame 13 and the matching network 17. The matching network 17 is held within the fixture 11 by an end cap 23 held in place by flanges 24.

To start the lamp of the present invention, a capacitive coupling is provided between the upper regions of the reentrant cavity 5 and the coil 7, as will be discussed hereinafter. Preferably, the cylinder 9 is attached to a support frame 13 by welds 9*a*. Such attachment reduces capacitive coupling between the coil 7 and the plasma since the cylinder 9 is electrically grounded to the fixture 11. Support frame 13 has a cylindrical flange 13*a* which fits within the fixture 11. Support frame 13 and flange 13*a* form the base of the lamp. The bottom or flare 1*a* of the envelope rests upon the support frame 13. Preferably, flange 13*a* is attached to fixture 11 by a weld 15 which can encircle the inside of the fixture 11. In this way, cylinder 9 can conduct heat from plasma in the envelope 1 through the support frame 13 and conduct it to fixture 11 for dissipation. Such dissipation is readily provided when the walls of the cylinder 9 have thicknesses between about 0.5 and 3 mm and a cylindrical diameter of 35 to 40 mm.

Figure 2A:
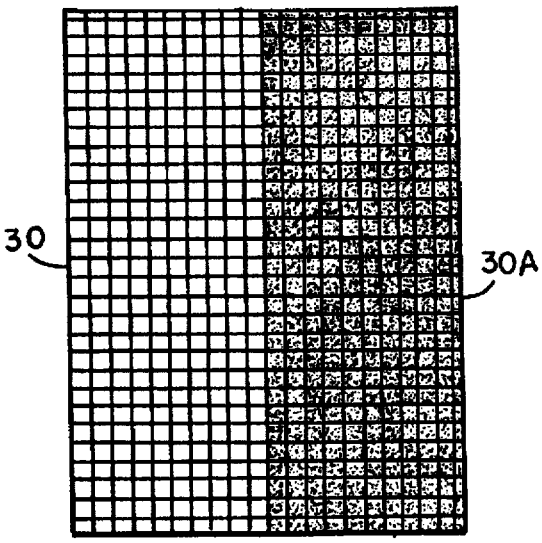
FIG. 2A is an elevational view of a foraminous substrate useful in the flag of the present invention coated with a material comprising indium to provide a rapid light buildup and also improved maintenance and protection from sputtering.
Figure 2B:
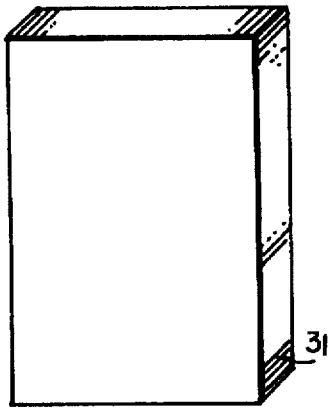
FIG. 2B is an elevational view of a foil section used to cover the substrate illustrated in FIG. 2A.
Figure 2C:
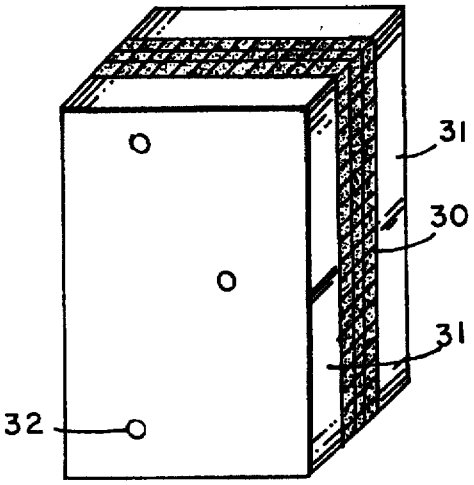
FIG. 2C is a perspective view of the flag of the present invention showing the disposition and attachment of the substrate of FIG. 2A between two foil sections such as shown in FIG. 2B.

As mentioned above, the basic attribute of the invention is to provide rapid buildup of mercury pressure after starting so full light output is reached relatively quickly. This has to be done in a manner that does not adversely effect the maintenance of the lamp. According to the invention, we provide an auxiliary amalgam flag 14 along the cavity 5 away from the glass, as shown in FIG. 1, in addition to the main amalgam 29 mentioned previously. This auxiliary amalgam 14 is provided on a substrate 30 of low heat capacity metal such as nickel-chromium, nickel-iron mesh, generally between about 0.1 and 0.2 mm thick, which does not absorb too much heat thereby making the heat available to the mercury amalgam, as shown in FIG. 2A. As for amalgam materials, we find a coating of indium or indium-bismuth or lead-indium-bismuth are satisfactory. The coating should have a thickness between about 0.01 and 0.1 mm. The critical parameter here is the fast release of mercury. It should be pointed out if the substrate is not protected from the ion bombardment of the discharge, particularly mercury ion bombardment, sputtering takes place and blackish material deposits on top of the phosphor close to the flag 14. These particles are typically deposited on the inner wall of the cavity 5 where the flag 14 is located. They reduce the luminosity of the area which deteriorates the light output over the life of the lamp. In order to ameliorate the problem we have enveloped the flag 14 with a metal shield 31 which has one of the lowest sputtering yields from mercury ion bombardment. The metals we experimented with were iron and molybdenum. In addition there are other metals, such as platinum, that can be utilized, however, they tend to be more expensive. Therefore, for economic reasons and in order to achieve the technical objective we concentrated on iron primarily.

We have found to insure the integrity of the substrate 30 and avoid the sputtering we take two very thin foils, generally between about 0.1 and 0.2 mm thick, of iron metal 31 and essentially sandwich the nickel-chromium mesh 30 which supports the amalgam between them. We prefer to use indium as the amalgam forming material. These two sheets 31 can be spot-welded at 32 in either one or two or several places such that the sandwich is not hermetically sealed and a very small opening is left at the periphery to allow mercury ions to diffuse in and amalgamate with indium. This is very important because if the diffusion of mercury is constricted, then the rapid light buildup does not take place because the mercury cannot be released very quickly.

When we experimented with just indium-mesh flags without any protection we found there was a fair amount of sputtering depending on where we located the flag 14. We experimented with different distances into the discharge and closer to the cavity 5 as well as up and down the cavity from the very top to the very bottom. We have found the sputtering and deposition of material was not really uniform. Typically, when the flag 14 was located at a distance corresponding to the middle of the coil 7 we found there was more sputtering. As we moved the flag 14 further away from the center of the discharge toward the weaker areas of the plasma, as shown in FIG. 1, we found the amount of deposition was less. This clearly indicated the axial location of the flag 14 was critical.

We also found the size of the flag 14 is of considerable importance. The size of the flag 14 is a compromise between the amount of light that needs to be obtained very rapidly and the speed with which this light is obtained in the first minute or so after the lamp starts. We have found the area of the flag 14 should be between about 4 and 8 $mm^2$. Our preferred dimensions were 2 mm×3 mm whereby in most cases we were able to obtain up to about 80% of the light output in less than 1 minute.

Figure 3:
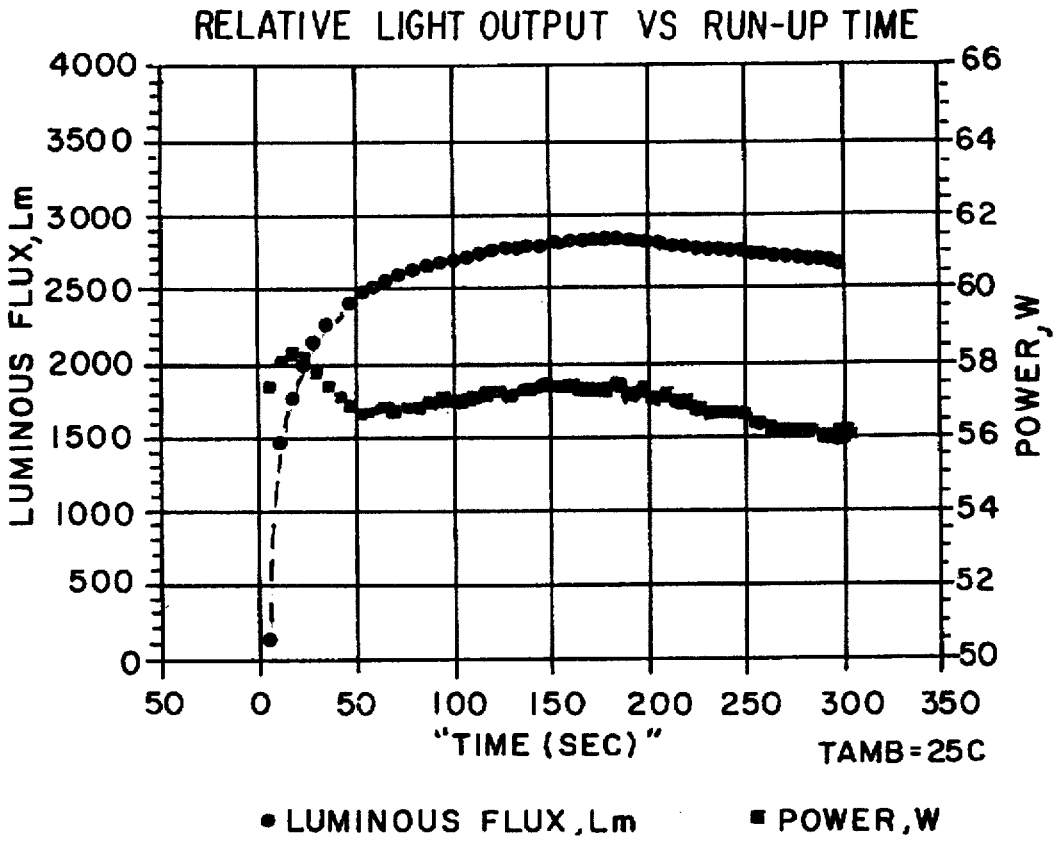
FIG. 3 is a curve showing experimentally-obtained data of the rapid buildup of light with the flag of the present invention.

In FIG. 3 we show our experimental results of the relative light output as a function of time with very short time scales. As shown in this figure, the light buildup is quite rapid and about 80% light output is obtained in less than a minute under a variety of experimental circumstances and for a variety of lamps. It is important to note these experiments were done carefully paying attention to the fact that if there is mercury on the walls of the envelope 1 or cavity 5, the buildup time attributable to the flag 14 can be clouded. This is because the envelope 1 warms up very quickly and releases the mercury, sometimes before the flag 14 does. Therefore, in order to insure all the mercury was either in the flag 14 or the main amalgam 29, we kept the lamps at room temperature for about 100–120 hours, unlit, and allowed the mercury to diffuse to the flag 14 and the main amalgam 29. The data reported in FIG. 3 were obtained with an automated and calibrated data acquisition system.

The next issue to be addressed is maintenance of the lamp, that is, light output deterioration over time. We experimented with various distances up and down the axial direction of the coil. We put it above the coil closer to the dome of the cavity, below the coil, in the middle of the coil and near the flare. We found the optimum distance was about 20 mm from the flare and this position was below the coil. We realized the deterioration of the maintenance is lower when the flag is at a point lower than the entire coil. Now inasmuch as sputtering was greatly reduced by utilization of the iron foil, it was not completely eliminated. However, the advantage of inserting the flag closer to the flare or base of the lamp is that there is relatively little amount of light coming out from that region. The plasma tends to be rather weak there and as a result there is not a large amount of light coming out. Therefore, the deterioration of a small amount of light on a relative basis is not of great concern. On the other hand, if the flag was located above the coil on top near the dome, there is a fair amount of radiation and luminosity from the area and, therefore, a small reduction of luminosity due to deposition of sputtered material in the particular area would be significant from a maintenance point of view.

In the preferred embodiment of our lamp, the lamp dimensions were 105 mm diameter and the length was 112 mm. The length of the cavity was 85 mm and the diameter was about 40 mm. The lamp contained about 40 pascal of argon and about 5 milligrams of mercury, all together of which we estimate about 1 milligram was in the flag. The main amalgam was 160 mg of In-Bi. This was mixed with about 3% of mercury. The size of the flag was mentioned above. The walls of the lamp were coated with a protective coating made of aluminum oxide. Additionally, the bulb was coated with lanthanum phosphate green phosphor and yttrium oxide red phosphor. Typically, the phosphor coverage was about 4 milligrams per square centimeter. The cavity, in addition to a protective coating to avoid mercury interaction with glass, had a reflective coating of aluminum oxide to reflect the visible radiation which is generated on it. The amalgam, as we said, was in the center tubulation and about 10 mm above the flare inside the cavity. Typically, it was constrained with a glass slug and a small constriction to prevent it from going into the lamp when the lamp was burned base up and the ambient temperature would be fairly high. The discharge was operated with a coil which had anywhere between 5 to 12 turns and operated at 13.56 MHz. This coil was connected to a conventional matching network which was coupled into a high frequency driver external to the lamp base and driven by AC voltage of 100 or 120 volts. The coil had a typical temperature of about 200° C. under extreme cases and in most cases closer to about 150° C. In order to reduce some of the heat generated by the discharge that went to the coil we surrounded the coil with an aluminum cylinder which carried the heat away down to the base and into the fixture and this has already been mentioned in copending U.S. patent applications Ser. Nos. 08/559,557 and 08/538,239, owned by the same assignee as the present application. This scheme has worked out very successfully in reducing the temperature of the matching network inside the base as well as for the coil.

It is apparent that changes and modifications can be made within the spirit and scope of the present invention, it is our intention, however, only to be limited by the scope of the appended claims. As our invention we claim:

In the claims:

1. A device for increasing the rate of luminous development in an electrodeless fluorescent lamp containing a fill comprising mercury, said device comprising:

a pair of spaced-apart metal foil sections;

a metallic substrate disposed between said foil sections whereby to be shielded from ion bombardment;

a coating comprising indium disposed on said substrate;

means for joining said sections together at one or more locations so openings are left about the periphery thereof for enabling migration of mercury atoms into and out of the space between said sections whereby to enable said atoms to form an amalgam with said indium and be rapidly released from said amalgam.

2. The device according to claim 1 wherein said substrate is foraminous whereby to increase the surface area for holding the indium.

3. The device according to claim 2 wherein said sections are comprised of iron and are spot-welded together.

4. The device according to claim 1 wherein said device is between about 4 and 8 $mm^2$.

5. A flag for increasing the rate of luminous development in an electrodeless fluorescent lamp containing a fill comprising mercury, said flag comprising:

a pair of spaced-apart iron foil sections;

a metallic mesh substrate disposed between said foil sections whereby to be shielded from ion bombardment occurring during operation of said lamp;

a coating comprising indium disposed on said mesh, said indium being adapted to amalgamate with mercury;

means for joining said sections together at one or more locations so openings are left about the periphery thereof for enabling migration of mercury atoms into and out of the space between said sections whereby to enable said atoms to form an amalgam with said indium and be rapidly released from said amalgam.

6. An electrodeless fluorescent lamp containing a fill comprising mercury, said device comprising a bulbous glass envelope having a reentrant cavity extending from a flare disposed at bottom end of said envelope, a tubulation depending from the top of said cavity adapted to receive said mercury and a coil disposed adjacent the top of said reentrant cavity above said flare and about said tubulation, said coil being adapted to induce a magnetic field in said envelope whereby to activate a discharge and to obtain mercury ultraviolet resonance radiation which impinges upon a phosphor that is coated on the inside walls of said envelope thereby to generate visible light, the improvement comprising:

a flag comprising a pair of spaced-apart metal foil sections disposed in said envelope and means for disposing said flag at a predetermined location in said envelope;

a metallic substrate disposed between said foil sections whereby to be shielded from ion bombardment;

a coating comprising indium disposed on said substrate;

means for joining said sections together at one or more locations so openings are left about the periphery thereof for enabling migration of mercury atoms into and out of the space between said sections whereby to enable said atoms to form an amalgam with said indium and be rapidly released from said amalgam.

7. The lamp according to claim 6 wherein said flag is attached to said reentrant cavity adjacent said flare at a point beneath said coil.

8. The lamp according to claim 7 wherein said flag is disposed so as to be adjacent the periphery of said discharge.

9. The device according to claim 6 wherein said substrate is foraminous whereby to increase the surface area for holding the indium.

10. The device according to claim 9 wherein said sections are comprised of iron and are spot-welded together.

11. The device according to claim 6 wherein said device is between about 4 and 8 $mm^2$.

* * * * *